United States Patent [19]

Fleissner

[11] Patent Number: 4,807,337

[45] Date of Patent: Feb. 28, 1989

[54] CRIMPING DEVICE FOR CRIMPING OF SYNTHETIC TEXTILE MATERIALS

[75] Inventor: Gerold Fleissner, Chur, Switzerland

[73] Assignee: Vepa AG, Riehen, Switzerland

[21] Appl. No.: 66,533

[22] Filed: Jun. 26, 1987

[30] Foreign Application Priority Data

Jun. 26, 1986 [DE] Fed. Rep. of Germany ..... 3621479
Aug. 5, 1986 [DE] Fed. Rep. of Germany ..... 3626522

[51] Int. Cl.[4] ..... D02G 1/12
[52] U.S. Cl. ..... 28/248; 28/269
[58] Field of Search ..... 28/248, 263, 269

[56] References Cited

U.S. PATENT DOCUMENTS 3,618,183 11/1971 Funk et al. ..... 28/269
3,800,373 4/1974 Fleissner ..... 28/248
4,521,944 6/1985 Stockbridge ..... 28/269 X
4,589,173 5/1986 Fleissner ..... 28/269

FOREIGN PATENT DOCUMENTS 2373621 8/1978 France ..... 28/248
5140458 4/1976 Japan ..... 28/248
613899 2/1986 Japan ..... 28/269
1571521 7/1980 United Kingdom ..... 28/269

*Primary Examiner*—Robert R. Mackey
*Attorney, Agent, or Firm*—Antonelli, Terry & Wands

[57] ABSTRACT

A device for the crimping of synthetic yarns, bundles or bands, which includes a pair of pressure rollers and a subsequent stuffer box chamber having two plates, arranged parallel to the axes of the rollers, of which one is mounted at least partially movable for reducing the chamber area, and two lateral walls, closing off the chamber to a nip of the pressure rollers. At the level of the nip of the pressure rollers and in each case positioned adjacent to the edge area of the end surface of a rollers, a pressure disk is provided onto. An adjustment unit which is connected to at least one sensing device, which holds, through the adjustment unit, the pressure disk against the end surface of the roller under a pressure force. The sensing device is constructed as an instrument for determining the bending, adjusted on the basis of the pressure force, of a carrier for the pressure disk and the pressure force is adjustable in dependence on the continuously determined bending of the carrier.

6 Claims, 2 Drawing Sheets

CRIMPING DEVICE FOR CRIMPING OF SYNTHETIC TEXTILE MATERIALS

This invention relates to a stuffer box crimping device of the type described in German Document Mo. DE-OS No. 24 03 970 or in U.S. Pat. No. 4,589,173, and more particularly to a crimping device having a stuffer box operatively associated with means for maintaining the pressure plates or disks in close contact with the end surfaces of a pair of pressure rollers.

A stuffer box crimping device is generally known and such a device comprises a pair of pressure rollers in a stuffer box chamber. This chamber is formed by a pair of plates arranged parallel to the axes of the rollers, one of the plates being movable, i.e. pivotal, for reducing the size of the chamber arranged downstream of the rollers and two lateral walls providing the sides of the chamber. Sealing of the nip between the pressure rollers in the area of the ends of the rollers remains a problem in such devices particularly, in the crimping of smoothly spun synthetic fibers. Usually the slit or spacing located at the nip between the pressure rollers is sealed on both its ends by pressure disks or plates which rest against the end faces of the pressure rollers. In order to assure a sufficient seal, the pressure disks or plates have to rest against the end faces of the pressure rollers under pressure. However, this pressure contact produces an increased wear, which makes frequent exchange of the pressure disks necessary. In the device according to the heretofore mentioned German patent publication, this problem has been eliminated by holding the pressure disk at a minimal, previously defined distance from the end faces of the pressure rollers, whereby a scanner measures the actual distance between the end faces of the pressure rollers and the respective pressure disk and then causes the adjustment of a new set distance. The readjustment of the pressure disk is done in a non-continuous manner in such a way that the pressure disk is pressed against the two end faces or surfaces of the two corresponding pressure rollers and then rolls back by a slight, adjustable distance. It has been shown that this type of adjustment of the pressure disk has the disadvantage that the fine and the finest fibers push themselves into the space of said adjustable distance and thus cause the break-down of the device. It should be pointed out that with certain fibers, the pressure disks have to be pressed in all cases with force against the end faces of the pressure rollers in order to attain a sufficient seal for the pressure roller nip.

Thus, maintaining an even pressure against the pressure disk is very difficult. On a purely theoretically basis, this appears to be possible without major problems. However, practical application has shown that measurement differences constantly appear due to uncontrollable temperature effects. During the start-up of the machine, the pressure rollers first have to be heated, but then the rollers have to be cooled during operation in order to retain the temperature of the rollers at a constant level. However, the necessary temperature regulating device only keeps the temperature of the roller constant within a certain temperature range, in which the lengthwise changes of the rollers cannot be avoided. Therefore, each of the rollers constantly changes its dimensions from the fixed position to the loose position, depending on the respective temperature, even if this is only 100th of a mm. In order to take into account the greatest heat expansion between the cold and hot state, the crimping machine is installed in its heated state. The additional heat generated by the crimping and the hot steam sprayed into the chamber for setting the crimp also cause temperature changes which then have the effect of increased wear on the pressure disks.

Starting out from the devices according to German Document Mo. DE-OS No. 19 59 863 or DE-OS No. 24 03 970, the invention is based on the problem to take measures by which the setting of the pressure disks against the end surfaces of the pressure rollers can be kept optimal at all times without either causing too much wear or, on the other hand, producing a gap, however small, into which fibers can slip in an undesirable manner.

To solve this problem, the invention provides a sensor device which serves as an instrument for determining the bending of a carrier or support of the pressure disk caused by the pressure force applied to the disks which then provides means for adjusting the pressure force in dependence on the continuously determined bending of the carrier, such as a lateral plate defining a side of the stuffer box.

The invention is thus based on the fact that with the creation of a pressure force that is sufficient for sealing, the carrier or holder of the pressure disk is subject to a certain amount of bending. If the amount of this bending is determined by sensitive instruments, this value can be used for adjusting the pressure force supplied to the disks. With the aid of the device according to the invention, it is thus possible to continuously determine the actual pressure in dependence on the produced bending of the carrier and thus to keep wear constant at a minimal admissible value. With the device according to the invention it is assured that even with temperature variations or other varying conditions on the machine which might cause variation in dimensions between the pressure disk and the end surfaces of the rollers, the pressure forces holding the pressure disk against the front surfaces of the rollers can remain constant and assure sufficient sealing.

It is suitable to have the adjustment conducted electronically. For this purpose, a device should be designed into which a desired value for the bending can be fed. If then, during the operation of the device, after adjustment in the warm state, an actual value occurs which differs from the set value, an adjustment is triggered for changing the pressure force. The set value can be anything, extending from zero to a value at which would assure extremely good sealing.

In the device according to the invention, it is advantageous to construct the sensor instrument as a pressure pickup. The pressure pickup is not measuring a change of the distance between the lateral plate and the end surfaces of the pressure rollers as a fine distance measurement, but the new pressure between the pressure disk and the end surfaces of the rollers caused by the changing distance. Such an electronically controlled pressure pickup can more sensitively measure bending of the carrier of the pressure disk on the basis of measured pulses.

It is also advantageous to design the pressure disk on the pressure surface facing the end portions of the rollers in a spatially bent state. It is known and usual to arrange the pressure disk parallel to the end surfaces of the delivery rollers. This arrangement cannot be changed during the operation of the crimping device. If then the carriers, i.e. the lateral walls, are bending with respect to the end surfaces of the rollers, or the disk all together suffers torque around its carrier in the crimping device due to the pressure force against the pressure disk needed for sealing, the pressure disk can no longer be arranged parallel to the end surfaces of the rollers. The consequence of this change in dimensions is a slanted wear of the pressure disk. In order to assure that under all operating conditions the pressure disk is always arranged parallel to the end surfaces of the pressure rollers, the invention has the provision to design the contacting surfaces of the pressure disk in a spatially bent manner, preferably crowned. If the contacting surface is designed accordingly, it is now possible to assure a parallel arrangement of the pressure disk against the end surfaces, even with a change in dimension of the lateral disk in relationship to the end surfaces of the delivery rollers.

The accompanying drawings show the stuffer box crimping device of the present invention wherein.

Figure 1:
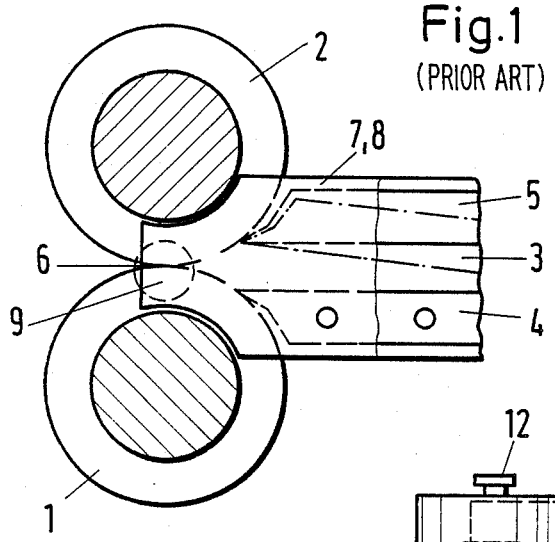
Fig.1 (PRIOR ART)
FIG. 1 is a side view of the crimping device.

The stuffer box crimping device consists of the delivery pressure rollers 1 and 2 and the chamber-forming plates 4 and 5, adjoining the pressure roller nip 6, forming between them the chamber area 3. The upper chamber-forming plate 5 is arranged downwardly movable (shown by dotted line) for a reduction of the chamber size. The lateral area of the chamber area is closed off by the lateral plates 7 and 8 shown in FIG. 2. Plates 7 and 8 are attached to the lower plate 4.

In the lateral plates 7, 8, at the height of the nip 6 of the pressure rollers, pressure or wear disks 9, 10 are held in each case, which are pressed by pressure cylinders 11, 12 against the end surfaces of the rollers 1, 2. Due to this pressure, the carriers or supports—here lateral plates 7, 8—bend in the directions of the arrows shown in FIG. 3. The amount of bending or torque can be measured and used as measurement for the actual friction between pressure disks and end surfaces of the rollers.

Figure 4:
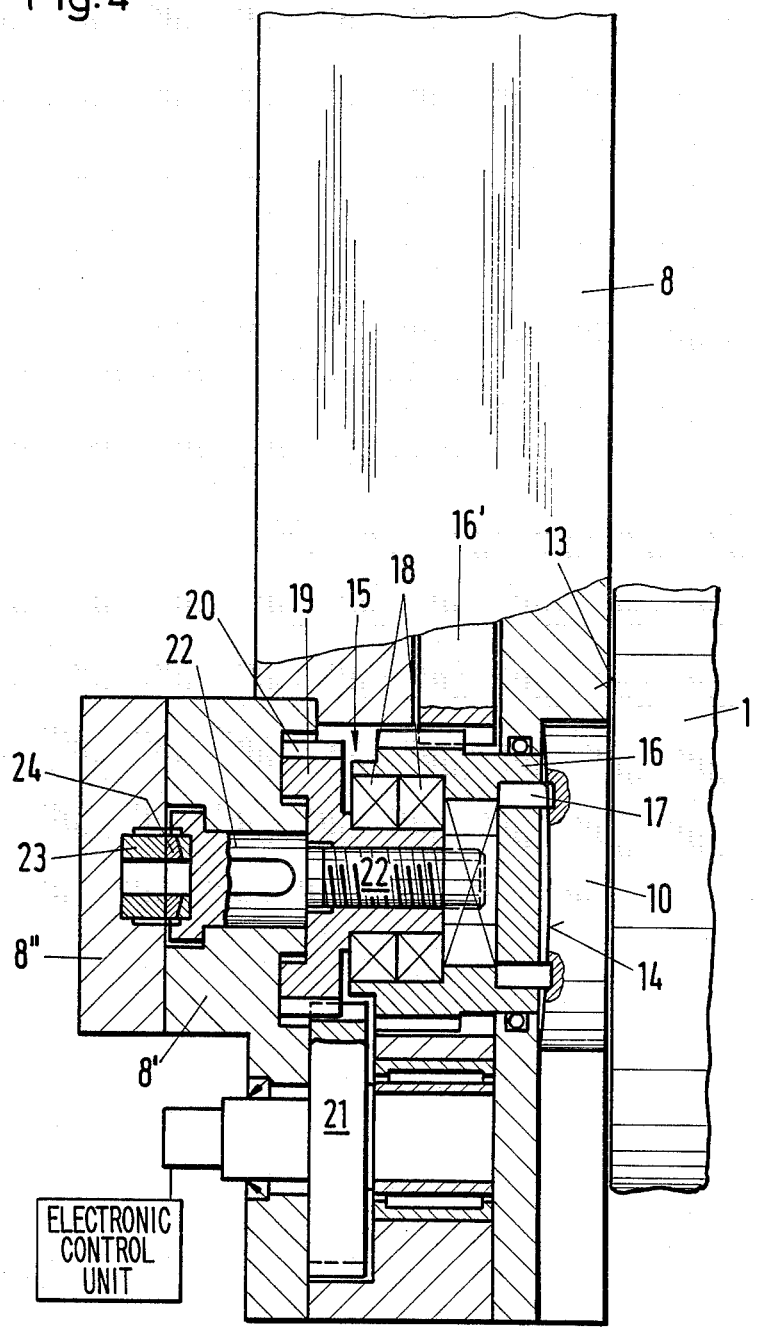
FIG. 4 is a cross-sectional view through one of the two lateral plates in the middle of the pressure disk and thus above the axis of one of the delivery rollers.

In FIG. 4, an embodiment of the construction and arrangement of the pressure disk with a scanning device is shown. The pressure disk 10 is built into the lateral plate 8. The pressure disk 10 has two surfaces. The wearing surface faces the end faces 13 of the draw-in roller pair 1, 2. The back surface—here called pressure force surface 14—is constructed in a spatially bent manner or even crowned. The crowned surface is built into the pressure disk, while the corresponding adjustment device, designated by reference numeral 15 overall, for adjusting the pressure disk in the area of the pressure force surface 14 is shaped in a convex crown fashion. Now, the pressure disk 10 can adjust itself according to the deflection or bending of the lateral plate 8, always parallel to the end surfaces 13 of the rollers 1, 2.

The specific construction of the adjustment device 15 is representative of one embodment of the invention. Device 15 consists of an outer toothed ring 16 which is provided with pins 17 at its front side in order to transfer the rotation of the toothed ring to the pressure disk for its even wear. Through ball bearings 18, the toothed ring 16 is mounted on an adjustment ring 19. The adjustment ring 19 has teeth 20 also along its outer circumference which engage the toothed drive wheel 21. An inside thread is cut into the center of the adjustment ring 19 which reaches into the corresponding outside thread of an adjustment bolt 22. The adjustment bolt 22 is held lengthwise mobile, but secured against torque in a part 8' of the lateral plate 8. A pressure pickup 23 is arranged on the outside end of the adjustment bolt 22 in another part 8'' of the lateral plate 8. The contact between the pressure pickup and the adjustment bolt 22 is assured through a bearing 24 which is also constructed in a crowned manner with a corresponding counter surface.

The operation of this device is as follows: the pressure disk is driven at even rotation through the toothed wheel 16' which engages into the teeth of the ring 16. The spacing or clearance adjustment of the pressure disk with respect to the end face of the roller occurs, however, via the toothed wheel 21 which has teeth that engage the teeth of the adjustment ring 19 and, due to the thread in the adjustment bolt 22, effects a spacing adjustment of the pressure disk 10 relative to the end surfaces of the roller 1. Simultaneously, the clearance of the pressure disk 10 is transferred from the end surface 13 of the roller 1 through the toothed ring 16 and the ball bearings 18, the adjustment ring 19 to the adjustment bolt 22, which, in turn, transfers this existing clearance to the pressure pickup 23. An electronic pulse from electrical means, not shown in detail in the drawing, provides for the drive of the toothed wheel 21 which regulates and holds constant pressure force of the pressure disk 10 against the end surface 13 of the rollers 1, 2 in dependence on the continuously determined bending of the carrier—here lateral plate 8.

Figure 3:
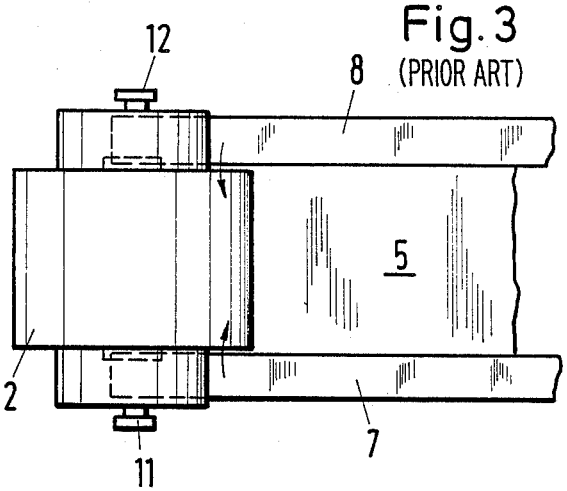
Fig.3 (PRIOR ART)
FIG. 3 is a top view of the device according to FIG. 1.
Figure 2:
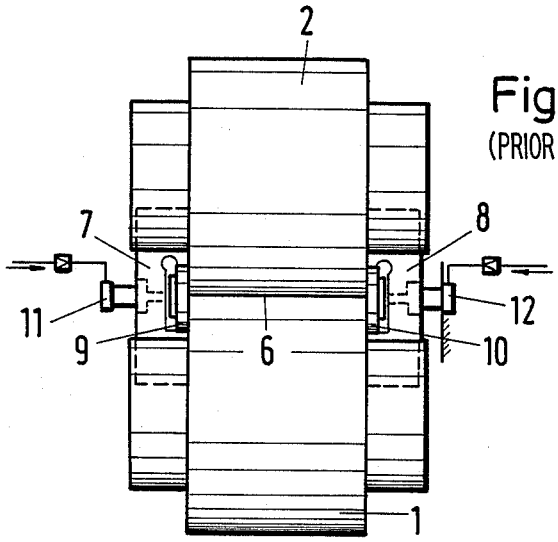
Fig.2 (PRIOR ART)
FIG. 2 is a front view of the device according to FIG. 1.

In FIGS. 2 and 3, elements 11 and 12 (pressure cylinders) represent a different arrangement than shown in FIG. 4. In the embodiment in FIG. 4, the force is not exerted on pressure disks 9 and 10 by pressure from a pressure cylinder, but by the rotation of gear 21 against gear 19. Both are fixed in housing 8', but are rotatably mounted. Therefore, pin 22 is displaced perpendicularly thereto, thus producing higher or lower pressure of pressure disk 10 against surface 13. However, this pressure also acts simultaneously via parts 16, 18, 19, 22 and 24 on pressure transducer 23, which in turn electrically controls the drive of gear 21. The entire arrangement as shown in FIG. 4 can also be made different as exemplified in FIGS. 2 and 3.

I claim:

1. A device for the crimping of synthetic yarns, bundles or bands, which comprises a pair of pressure rollers with a nip formed therebetween and a stuffer box chamber arranged downstream of said pressure rollers, said chamber comprising two plates arranged in parallel to axes of the rollers, one of which is mounted to be at least partially movable for reducing the chamber area, and two lateral walls closing off the sides of the chamber adjacent to said nip of the pressure rollers, a pressure disk located in each of the lateral walls at the level of the nip of the pressure rollers and in engagement with an edge area of the end surfaces of the rollers, an adjustment unit acting on each pressure disk, said adjustment unit being connected to at least one sensing device which, via the adjustment unit, presses the pressure disk against the end surfaces of the rollers under a pressure force, the sensing device comprising an instrument for determining bending, adjusted on the basis of the pressure force, of the lateral wall containing the pressure disk and the pressure force being adjustable by said adjustment unit in dependence of the continuously determined bending of the lateral wall.

2. A device according to claim 1, wherein said adjustment unit includes control means having an electronic unit, a set value for the bending of the lateral wall being fed into the electronic unit of the control means and the occurring actual value of bending of the lateral wall determined by the sensing device being compared with the set value in said electronic unit effecting adjustment of the pressure force applied to the disk.

3. A device according to claim 1, wherein the instrument comprises a pressure pickup transducer.

4. A device according to claim 1, wherein each pressure disk is constructed spatially bent on a pressure force surface facing away from a corresponding front surface of the rollers.

5. A device according to claim 4, wherein the pressure force surface is constructed in a crowned manner.

6. A device according to claim 5, wherein the pressure force surface has a concave face and a corresponding surface of the adjustment unit is made convex.

* * * * *